US010411368B2

(12) United States Patent
Mestars

(10) Patent No.: US 10,411,368 B2
(45) Date of Patent: Sep. 10, 2019

(54) ELECTRICAL TERMINAL AND METHOD

(71) Applicant: Phoenix Contact GmbH & Co. KG, Blomberg (DE)

(72) Inventor: Jochen Mestars, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/084,575

(22) PCT Filed: Apr. 3, 2017

(86) PCT No.: PCT/EP2017/057855

§ 371 (c)(1),
(2) Date: Sep. 13, 2018

(87) PCT Pub. No.: WO2017/182258

PCT Pub. Date: Oct. 26, 2017

(65) Prior Publication Data

US 2019/0081417 A1 Mar. 14, 2019

(30) Foreign Application Priority Data

Apr. 20, 2016 (LU) ..... 93033

(51) Int. Cl.
*H01R 4/48* (2006.01)
*H01R 4/50* (2006.01)
(Continued)

(52) U.S. Cl.
CPC ..... *H01R 4/4827* (2013.01); *H01R 4/5008* (2013.01); *H01R 4/52* (2013.01); *H01R 4/64* (2013.01)

(58) Field of Classification Search
CPC .... H01R 4/5008; H01R 4/505; H01R 4/4827; H01R 4/52; H01R 4/64; H01R 4/4836; H01R 4/4845; H01R 4/4881; H01R 4/489
(Continued)

(56) References Cited

U.S. PATENT DOCUMENTS 9,219,332 B2 * 12/2015 Wendt ..... H01R 13/629
9,543,668 B2 * 1/2017 Wendt ..... H01R 4/5008
(Continued)

FOREIGN PATENT DOCUMENTS

DE 102013108116 A1 2/2015
DE 102013110479 A1 3/2015
EP 0780923 A2 6/1997

*Primary Examiner* — Gary F Paumen
(74) *Attorney, Agent, or Firm* — Leydig, Voit & Mayer, Ltd.

(57) ABSTRACT

A connection terminal for connecting at least one electrical conductor includes: a clamping element which is arranged on a receiving element so as to be able to pivot about a shaft between an open position and a clamping position, the clamping element forming, together with a contact element, a clamping point for the electrical conductor; and an actuating arm for receiving an actuating tool, a first free limb of the actuating arm being pivotally arranged on the clamping element so as to be spaced apart from the shaft thereof such that, by pivoting the actuating arm using the actuating tool, the clamping element is able to shift from the open position into the clamping position and vice versa. A second free limb of the actuating arm is movably guided over at least one cam.

10 Claims, 6 Drawing Sheets

(51) Int. Cl.
*H01R 4/52* (2006.01)
*H01R 4/64* (2006.01)

(58) Field of Classification Search
USPC ..... 439/441, 437, 838, 864, 822, 836, 837, 439/828
See application file for complete search history.

(56) References Cited

U.S. PATENT DOCUMENTS

| | | | | |
|---|---|---|---|---|
| 9,761,961 | B2 * | 9/2017 | Wendt | H01R 4/4827 |
| 2014/0322957 | A1 * | 10/2014 | Wendt | H01R 4/489 439/370 |
| 2016/0149319 | A1 | 5/2016 | Wendt | |
| 2016/0211592 | A1 | 7/2016 | Wendt et al. | |

* cited by examiner

ELECTRICAL TERMINAL AND METHOD

CROSS-REFERENCE TO PRIOR APPLICATIONS

This application is a U.S. National Phase application under 35 U.S.C. § 371 of International Application No. PCT/EP2017/057855, filed on Apr. 3, 2017, and claims benefit to Luxembourg Patent Application No. 93033, filed on Apr. 20, 2016. The International Application was published in German on Oct. 26, 2017 as WO 2017/182258 under PCT Article 21(2).

FIELD

The present invention relates to a connection terminal for connecting at least one electrical conductor, comprising a clamping element which is arranged on a receiving element so as to be able to pivot about a shaft between an open position and a clamping position, the clamping element forming, together with a contact element, a clamping point for the electrical conductor. The present invention also relates to a method for connecting at least one electrical conductor to a connection terminal.

BACKGROUND

A connection terminal of this kind is known for example from DE 10 2013 108 116 A1 from the applicant's organization. In this known connection terminal, an actuating arm that is movably mounted by means of a slotted guide is moved by an actuating tool in order to close or open a clamping point.

The known connection terminals are disadvantageous in that they usually comprise a plurality of movable individual parts, resulting in a complex and thus cost-intensive manufacturing process.

SUMMARY

In an embodiment, the present invention provides a connection terminal for connecting at least one electrical conductor, comprising: a clamping element which is arranged on a receiving element so as to be able to pivot about a shaft between an open position and a clamping position, the clamping element forming, together with a contact element, a clamping point for the electrical conductor; and an actuating arm configured to receive an actuating tool, a first free limb of the actuating arm being pivotally arranged on the clamping element so as to be spaced apart from the shaft thereof such that, by pivoting the actuating arm using the actuating tool, the clamping element is configured to shift from the open position into the clamping position and vice versa, wherein a second free limb of the actuating arm is movably guided over at least one cam.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
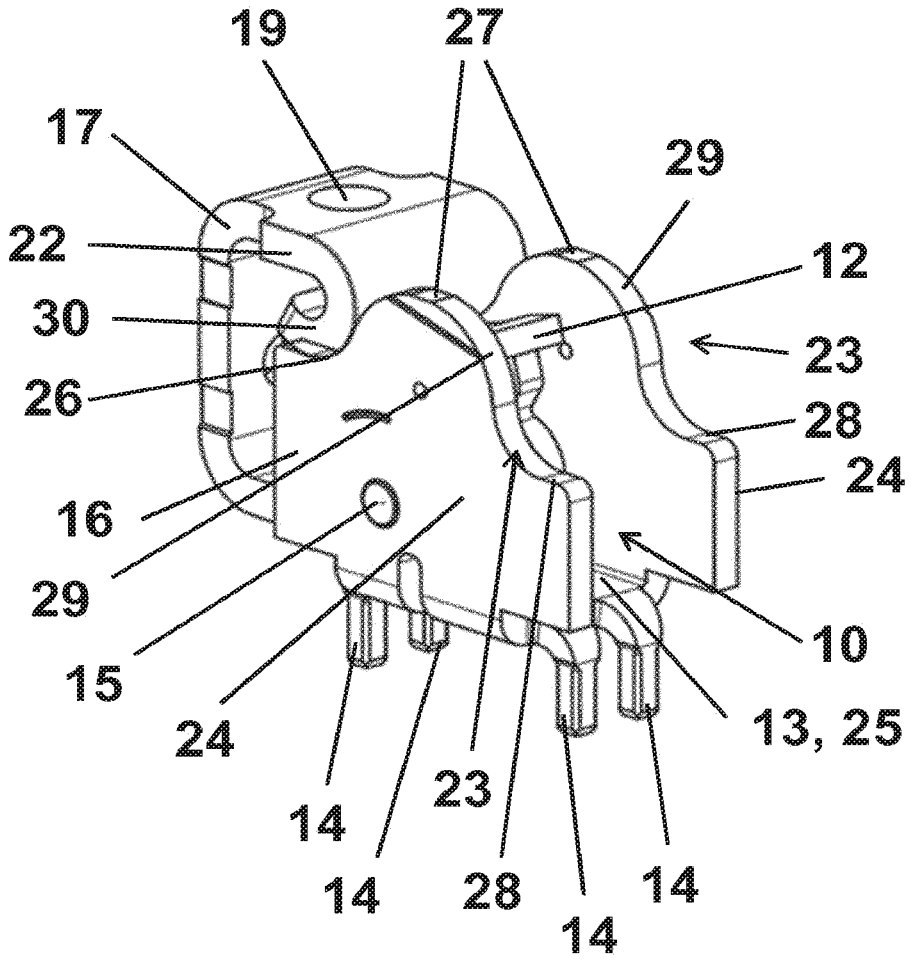
FIG. 1 is a perspective view of a connection terminal according to the invention in an open position.

The present invention provides a connection terminal of which the manufacturing complexity is minimized, but which is also simple and convenient to operate and ensures a reliable clamping connection to an electrical conductor inserted into the connection terminal. The invention also provides a corresponding method for connecting an electrical conductor.

In an embodiment, the present invention provides an arrangement having the above-mentioned features in that a second free limb of the actuating arm is movably guided over at least one cam. This offers the advantage whereby a reliable clamping effect is achieved whilst using a minimal number of individual parts. The cam is designed such that the second limb of the actuating arm is automatically held in the closed position, i.e. in the clamping position. The connection terminal according to the invention thus remains in the clamping position independently—without any external force effect by means of the actuating tool. The second limb is guided over the cam only by pivoting the actuating arm by means of the actuating tool. In this way, the connection terminal according to the invention is designed to be able to shift from the clamping position into the open position, and vice versa. The cam or lead cam and the second limb form a mechanical system which is self-locking in the clamping position. The low number of individual parts required and the minimalistic kinematics associated therewith are particularly advantageous, as a result of which the production cost is significantly reduced.

An expedient embodiment of the invention is characterized in that the at least one cam is formed by the receiving element. In other words, the cam is an integral component of the receiving element. In this way, the production cost is reduced even further. The receiving element is designed to hold further parts, such as the clamping element, and is used as a cam control to movably guide the second limb of the actuating arm.

A preferred development of the invention is characterized in that the receiving element has a substantially U-shaped profile, each lateral surface comprising the relevant cam. The two side parts therefore each form lateral walls which form a receiving space for the electrical conductor inserted into the clamping point. It is particularly advantageous for each of the lateral surfaces to form one of the cams, which preferably have the same contour. In this way, the shaft about which the clamping element is pivotally arranged is mounted on both sides on the lateral surfaces. At the same time, the second limb of the two cams is movably guided. Advantageously, it is therefore possible to easily insert the electrical conductor into the receiving space by pivoting.

According to a further preferred embodiment of the invention, the at least one cam has an outline which steadily transitions from an open position portion via a camber portion into a clamping position portion. The above-mentioned outline of the cam is advantageous in that the connection terminal according to the invention automatically remains in the clamping position. In order to reach the clamping position from the open position, or vice versa, the second free limb of the actuating arm is intended to initially be moved over the camber portion of the cam by applying an actuating force by means of the actuating tool.

A second expedient embodiment of the invention is characterized in that a transition region is formed between the camber portion and the clamping position portion so as to slope monotonically. This can have an impact on the increase in the actuating force of the connection terminal when shifting from the open position into the clamping position. In other words, the force path of the actuation force can be preset by specifying a cam geometry. The sloping transition region therefore supports the shift into the clamping position. The transition region is preferably curved, but can also extend linearly, at least along one portion.

According to a further preferred embodiment, the free second limb abuts the at least one cam and thus forms a sliding guide. As such, no other components are needed and the total number of individual parts required is reduced to a minimum. The second limb is designed such that it rests on the at least one cam. Preferably, an end region of the second free limb, by means of which region said limb rests on the cam, is rounded. More preferably, the end region is formed by a turned-up portion. More preferably, the second limb is selected to be as wide as the width of the receiving element having a U-shaped profile, such that the second limb rests on each of the lateral surfaces which are designed as cams.

A further expedient embodiment of the invention is characterized in that the free second limb abuts the cams of the lateral surfaces by means of a guide shaft. The guide shaft offers further functional advantages. The free second limb thus bears linearly on the cams by means of the guide shaft, and allows precise guiding by said cams. Possible deformations of the free limb and/or of the actuating arm on account of the forces acting during the actuation process therefore have no impact on the guiding of the free limb by means of the cams, and therefore precise cam guiding is ensured at all times. The guide shaft is preferably rotatably mounted on the second limb. It is further preferable for the end region of the second limb to be formed by a turned-up portion that is designed as a receiving bearing for the guide shaft.

According to a further preferred embodiment of the invention, the receiving element and the contact element are integral and electrically conductive. This makes it possible to achieve a further reduction in the total number of components.

The receiving element is preferably made in one piece, for example as a stamped part. More preferably, the lateral surfaces are formed by upstands. The receiving element therefore advantageously simultaneously forms the contact element which, together with the clamping element, forms the contact point for the electrical conductor. More preferably, either soldering pins for mounting on a printed circuit board of the connection terminal according to the invention, or other connection elements are provided on the receiving element.

A second expedient embodiment of the invention is characterized in that the actuating arm is designed as a spring U-bolt. The spring U-bolt therefore abuts the cam under spring-preloading in the clamping position. Reliable contacting and clamping of the electrical conductor in the clamping position is thus ensured, together with said conductor automatically remaining in the clamping position. In addition, the spring-preloading by means of the spring U-bolt results in the second free limb automatically shifting out of a position in which said limb is in the region of the camber portion and into the open position portion of the cam.

Furthermore, the invention provides a corresponding method having the features specified at the outset, the connection terminal comprising a clamping element which is arranged on a receiving element so as to be able to pivot about a shaft between an open position and a clamping position, and the clamping element forming, together with a contact element, a clamping point for the electrical conductor, comprising the following steps: placing the electrical conductor into the clamping point in the open position, inserting an actuating tool into an actuating arm designed therefor of the connection terminal, pivoting the actuating arm by means of the actuating tool in order to shift the clamping element from the open position into the clamping position by means of a first free limb of the actuating arm which is pivotally arranged on the clamping element so as to be spaced apart from the shaft thereof, and guiding a second limb of the actuating arm over at least one cam. The advantages of the method according to the invention emerge analogously to the above-mentioned advantages of the connection terminal according to the invention, to which reference is made in order to avoid repetition.

FIG. 1 schematically shows a connection terminal according to the invention in perspective view in the open position. The connection terminal shown is in a position in which the clamping point 10 is open so that an electrical conductor 11 (shown in FIGS. 4 and 5) can be inserted into the clamping point 10 or can be removed again. The clamping point 10 is formed by a clamping element 12 and a contact element 13. The contact element 13 is preferably designed as a current bar. The contact element 13 is further designed to contact additional electrical assemblies. The contact element 13 can thus comprise for example soldering pins 14 for mounting on a printed circuit board, or can be designed as a plug-in element for providing a detachable electrical connection to additional assemblies.

The clamping element 12 is arranged on a receiving element 16 so as to be able to pivot about a shaft 15. The contact element 13 is thus designed to be able to move between the open position shown in FIG. 1 and the clamping position shown in FIG. 2. In the clamping position, the electrical conductor 11 inserted into the clamping point 10 is pressed against the contact element 13 by the clamping element 12. In this way, the electrical conductor 11 is mechanically jammed in the clamping point and is protected against unintentional detachment from the clamping point 10, and electrical contact is simultaneously achieved between the electrical conductor 11 and the contact element 13.

The connection terminal according to the invention further comprises an actuating arm 17. The actuating arm 17 is designed to receive an actuating tool 18 (shown in FIGS. 4 and 5), for example a screwdriver. For this purpose, the actuating arm 17 preferably comprises a hole 19 which is designed to receive the actuating tool 18. By means of the actuating tool 18, the connection terminal according to the invention can be shifted from the open position into the clamping position and vice versa.

Figure 2:
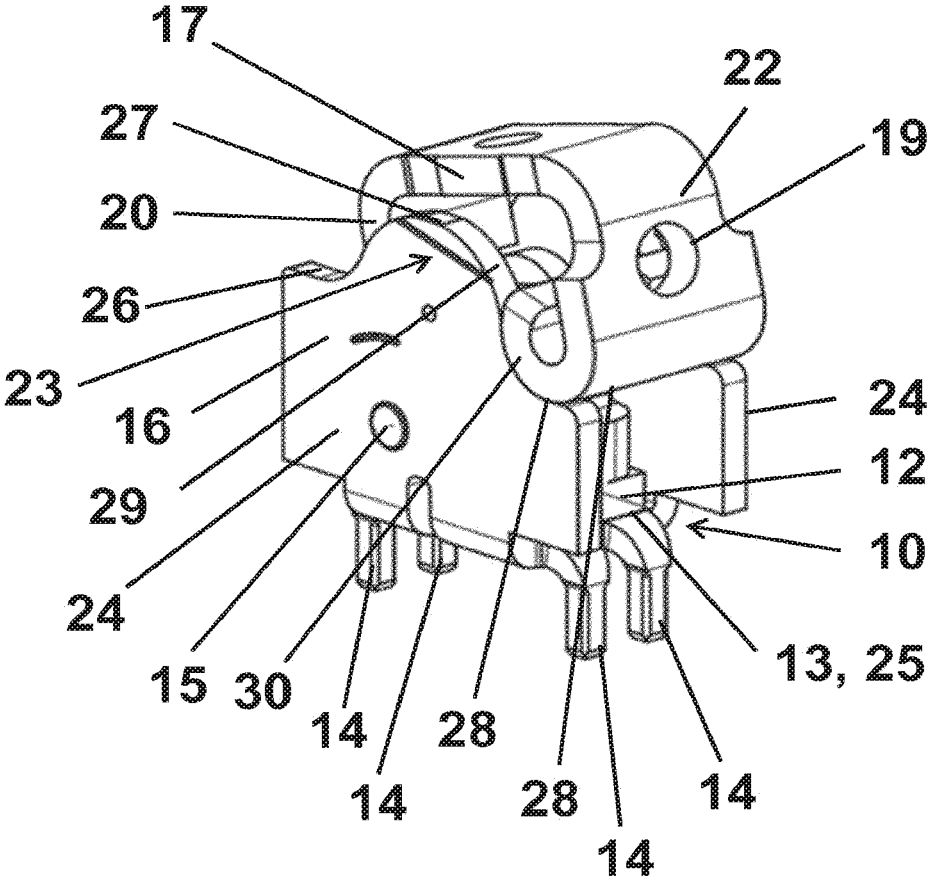
FIG. 2 shows the connection terminal shown in FIG. 1 in a clamping position.
Figure 3:
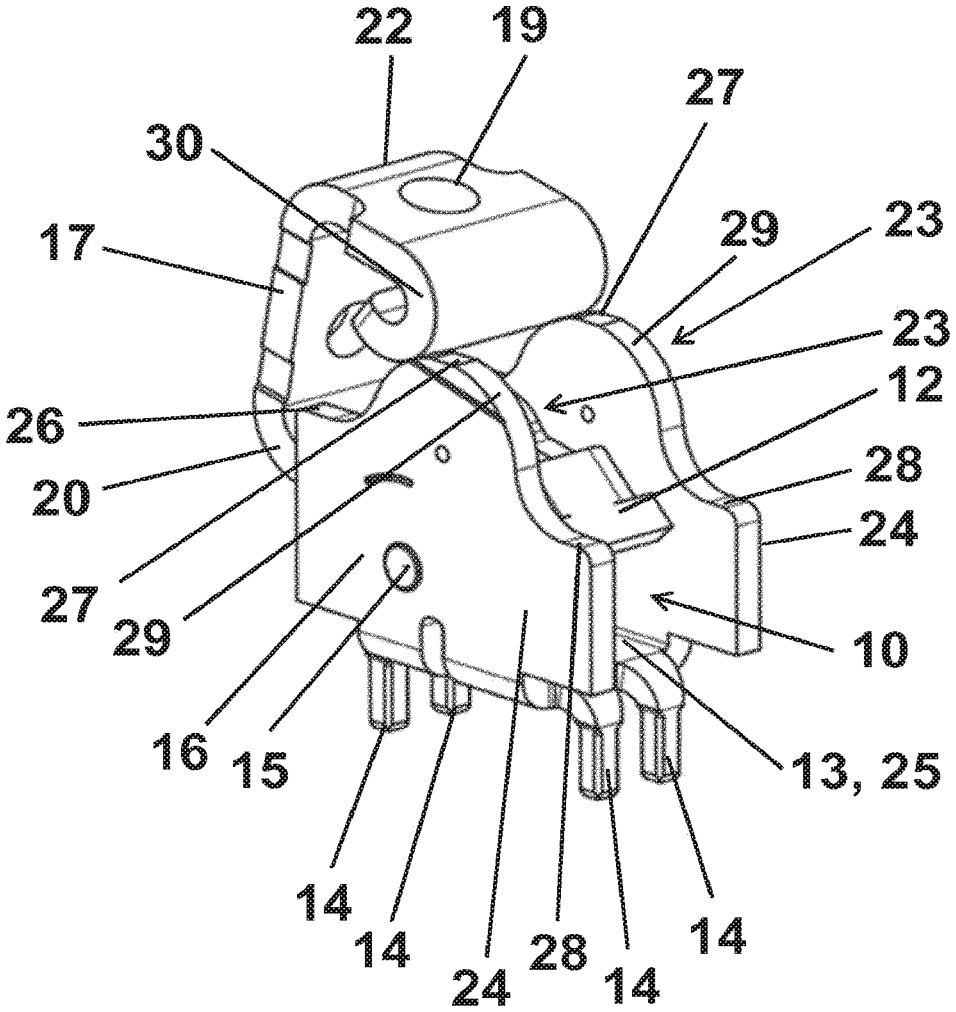
FIG. 3 shows the connection terminal shown in FIG. 1 in an intermediate position.

This action is shown schematically in FIGS. 2 and 3. FIG. 2 schematically shows the connection terminal according to the invention in perspective view in the clamping position, whereas an intermediate position is shown in FIG. 3.

Figure 4:
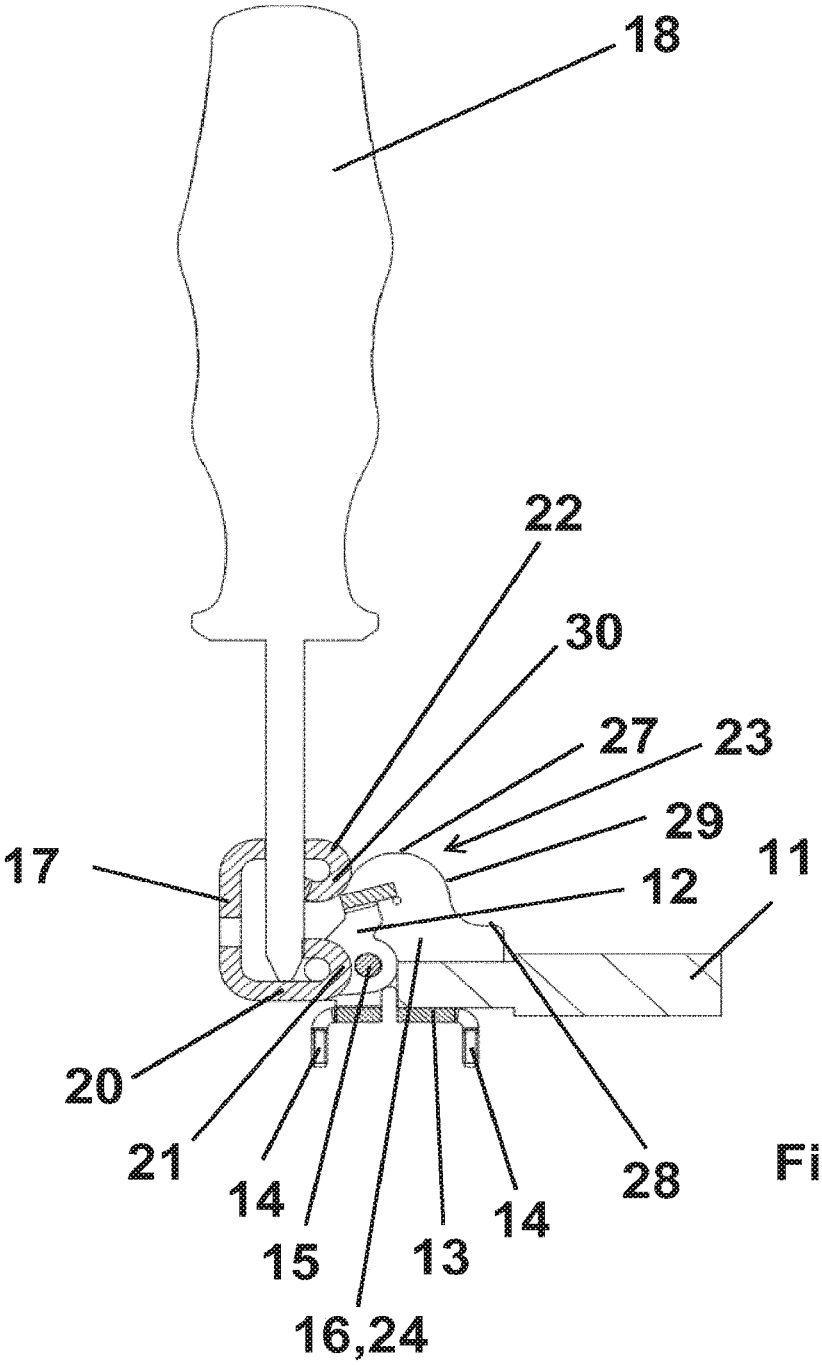
FIG. 4 is a cross section of the connection terminal according to the invention having an actuating tool inserted therein, in the open position.

As can be seen in particular in the cross section of the connection terminal shown in FIG. 4, a first free limb 20 of the actuating arm 17 is pivotally arranged on the clamping element 12 so as to be spaced apart from the shaft 15 thereof. Preferably, the end of the free limb 20 is designed as a first tab element 21 and forms a receiving portion for the shaft 15 of the clamping element 12. More preferably, the shaft 15 is arranged on the clamping element 12 as a pin. Advantageously, the shaft 15 and the clamping element 12 are integral. Alternatively, the shaft 15 is guided through a recess in the clamping element 12 as a separate part. By pivoting the actuating arm 17 by means of the actuating tool 18, the clamping element 12 is designed to be able to shift from the open position into the clamping position, and vice versa.

A second free limb 22 of the actuating arm 17 is movably guided over at least one cam 23. Particularly preferably, the at least one cam 23 is formed by the receiving element 16. In other words, the at least one cam 23 is an integral component of the receiving element 16 and is designed as a single part.

The receiving element 16 preferably has an at least substantially U-shaped profile, i.e. is U-shaped or is substantially U-shaped. The receiving element 16 has lateral surfaces 24 which are interconnected by means of a base element 25 positioned therebetween. The base element 25 preferably simultaneously forms the contact element 13. However, alternatively, the contact element 13 can also be arranged on the base element 25. Each of the lateral surfaces 24 advantageously comprises one of the cams 23. More preferably, the outline or contour of each of the two cams is identical.

Advantageously, the at least one cam 23 has an outline which steadily transitions from an open position portion 26 via a camber portion 27 into a clamping position portion 28. As shown in the drawings, the cam has a steady curved shape, which is roughly divided up into the above-mentioned portions. With respect to the base element 25 as a reference plane, the outline of the cam 23 cambers in the camber portion 27, and thus exceeds the level of the open position portion 26 and the clamping position portion 28 of the cam 23 in each case. More preferably, the level of the clamping position portion 28 with respect to the base element is selected to as to be deeper than the level of the open position portion 26, in particular a transition region 29 is formed between the camber portion 27 and the clamping position portion 28 so as to slope monotonically. In other words, when the actuating arm 17 is pivoted by means of the actuating tool 18, the second free limb 22 is guided by means of the cam 23, proceeding from the open position portion 26, over the camber portion 27, and from here is guided over the transition region 29 which slopes monotonically towards the clamping position portion 28.

The free second limb 22 preferably abuts the at least one cam 23 and thus forms a sliding guide. For example, the end of the second free limb 22 is designed as a second tab element 30. Alternatively, the second free limb 22 abuts the cams 23 of the lateral surfaces 24 by means of a guide shaft. The bearing force with which the second free limb 22 presses in the direction of the cams 23 is thus transmitted linearly to the cams 23 by means of the guide shaft.

Advantageously, the receiving element 16 and the contact element 13 are integral and electrically conductive. In other words, the receiving element 16 and the contact element 13 are made from one electrically conductive part, for example as a stamped part. The actuating arm 17 is preferably designed as a spring U-bolt. By means of the actuating arm 17 designed as a spring U-bolt, the free second limb 22 is pulled against the at least one cam 23 under spring-preloading. The spring U-bolt is preferably designed such that there is no spring-preloading in the open position, but this steadily increases during pivoting into the clamping position. On account of the increasing spring force and the previously described cam geometry, automatic locking in the clamping position is achieved.

Figure 5:
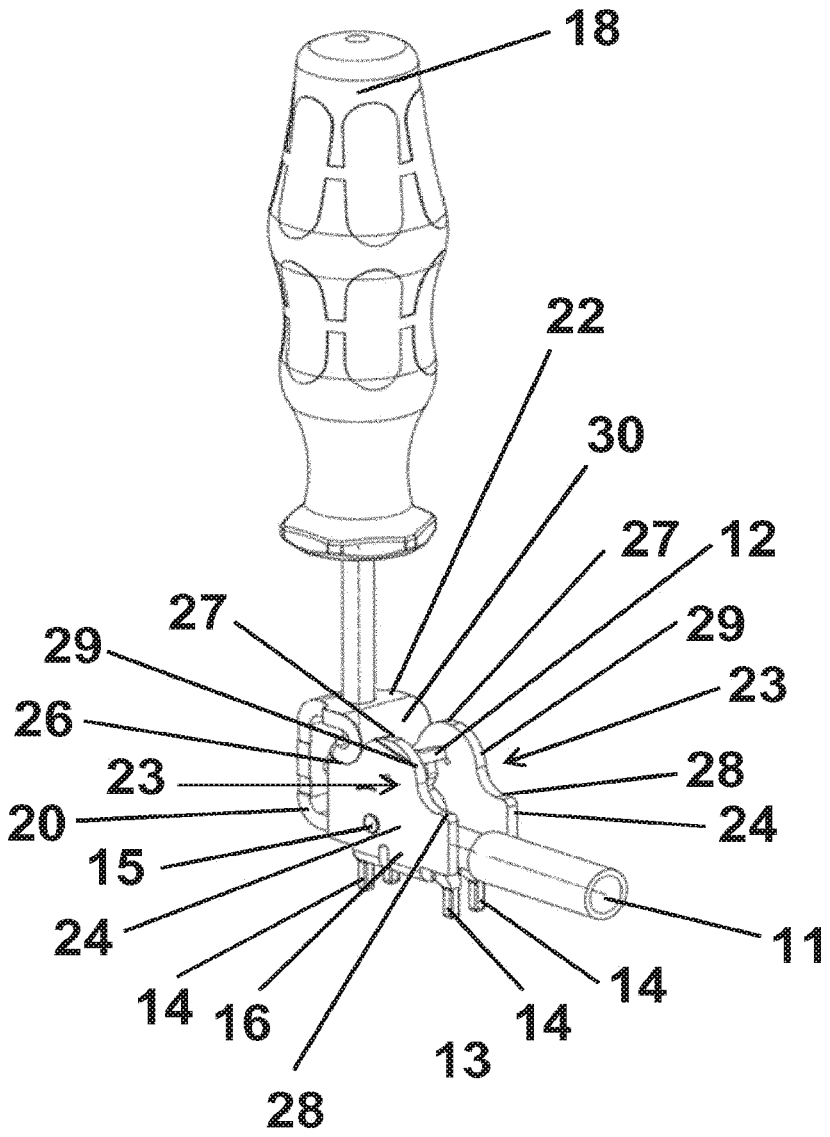
FIG. 5 is a perspective view of the connection terminal according to the invention having an actuating tool inserted therein, in the open position.

In FIG. 5, the previously described connection terminal according to the invention is shown schematically in perspective view in the open position and having an actuating tool 18 inserted therein.

Figure 6:
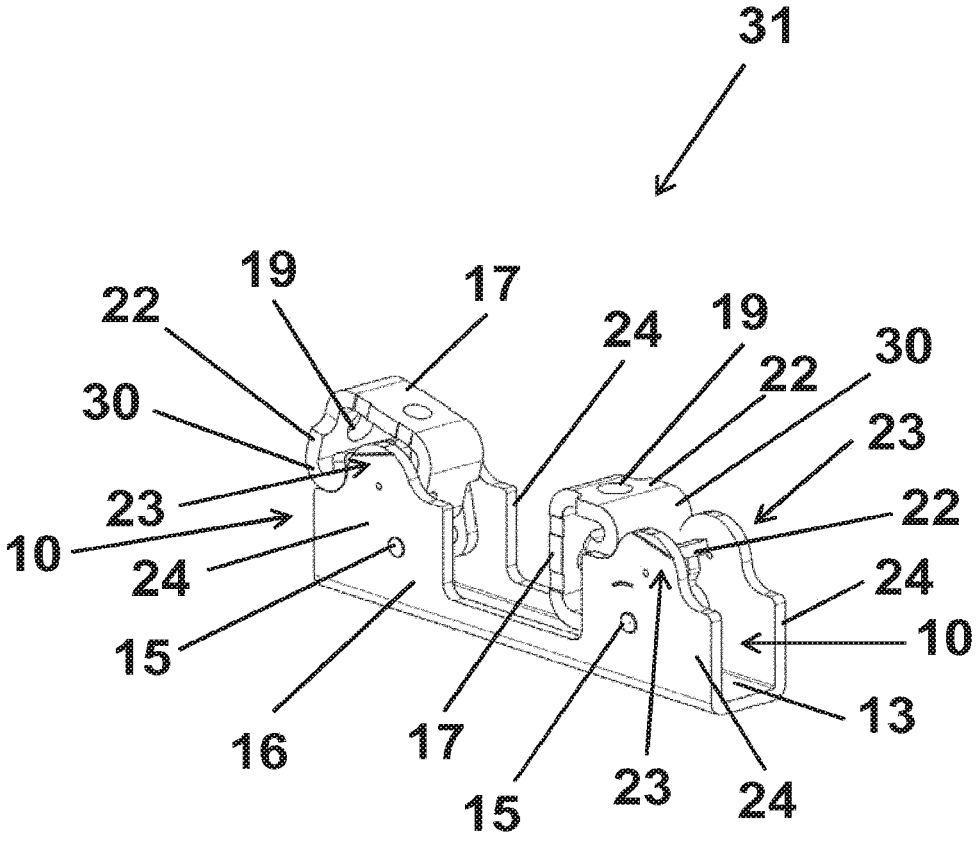
FIG. 6 is a perspective view of a through-terminal according to the invention.

A further advantageous embodiment of the invention is shown schematically in FIG. 6. The perspective view according to FIG. 6 shows a through-terminal 31 according to the invention. The through-terminal 31 comprises two of the connection terminals according to the invention having the features which were described in detail above. Advantageously, the receiving element 16 of the two connection terminals is integral, such that the two connection terminals are interconnected both mechanically and also electrically.

The connection terminal according to the invention described previously and also the through-terminal according to the invention are preferably surrounded by an insulating-material housing. More preferably, the various terminal types according to the invention are designed as terminal blocks.

The object is achieved by a corresponding method. The method according to the invention for connecting the electrical conductor 11 to the connection terminal according to the invention comprises the following steps. The electrical conductor 11 is initially placed into the clamping point 10 of the connection terminal, which is in the open position. Subsequently, the actuating tool 18 is inserted into the actuating arm 17 designed therefor. By pivoting the actuating arm 17 by means of the actuating tool 18, the clamping element 12 is shifted from the open position into the clamping position on account of the previously described interaction of the parts arranged accordingly on the receiving element 16, such as the clamping element 12 and the actuating arm 17. In this process, the second free limb 22 of the actuating arm 17 is guided over the at least one cam 23. Further advantageous embodiments of the method according to the invention emerge from the above embodiments with respect to the connection terminal according to the invention, to which reference is made in order to avoid repetition.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

10 clamping point
11 electrical conductor
12 clamping element
13 contact element
14 soldering pin
15 shaft
16 receiving element
17 actuating arm
18 actuating tool
19 hole
20 first free limb
21 first tab element
22 second free limb
23 cam
24 lateral surfaces
25 base element
26 open position portion
27 camber portion
28 clamping position portion
29 transition region
30 second tab element
31 through-terminal

The invention claimed is:

1. A connection terminal for connecting at least one electrical conductor, comprising:

a clamping element which is arranged on a receiving element so as to be able to pivot about a shaft between an open position and a clamping position, the clamping element forming, together with a contact element, a clamping point for the electrical conductor; and an actuating arm configured to receive an actuating tool, a first free limb of the actuating arm being pivotally arranged on the clamping element so as to be spaced apart from the shaft thereof such that, by pivoting the actuating arm using the actuating tool, the clamping element is configured to shift from the open position into the clamping position and vice versa, wherein a second free limb of the actuating arm is movably guided over at least one cam.

2. The connection terminal according to claim 1, wherein the at least one cam is formed by the receiving element.

3. The connection terminal according to claim 2, wherein the receiving element has a substantially U-shaped profile, each lateral surface comprising the relevant cam.

4. The connection terminal according to claim 1, wherein the at least one cam has an outline which steadily transitions from an open position portion via a camber portion into a clamping position portion.

5. The connection terminal according to claim 4, wherein a transition region is formed between the camber portion and the clamping position portion so as to slope monotonically.

6. The connection terminal according to claim 1, wherein the free second limb abuts the at least one cam and thus forms a sliding guide.

7. The connection terminal according to claim 3, wherein the free second limb abuts the cams of the lateral surfaces via a guide shaft.

8. The connection terminal according to claim 1, wherein the receiving element and the contact element are integral and electrically conductive.

9. The connection terminal according to claim 1, wherein the actuating arm comprises a spring U-bolt.

10. A method for connecting at least one electrical conductor to a connection terminal, the connection terminal comprising a clamping element which is arranged on a receiving element so as to be able to pivot about a shaft between an open position and a clamping position, the clamping element forming, together with a contact element, a clamping point for the electrical conductor, the method comprising the following steps:

placing the electrical conductor into the clamping point in the open position;

inserting an actuating tool into a therefor configured actuating arm of the connection terminal;

pivoting the actuating arm using the actuating tool in order to shift the clamping element from the open position into the clamping position via a first free limb of the actuating arm which is pivotally arranged on the clamping element so as to be spaced apart from the shaft thereof; and guiding a second free limb of the actuating arm over at least one cam.

* * * * *